US005605287A

United States Patent [19]

Mains

[11] Patent Number: 5,605,287

[45] Date of Patent: Feb. 25, 1997

[54] AIRBLAST FUEL NOZZLE WITH SWIRL SLOT METERING VALVE

[75] Inventor: Robert T. Mains, Euclid, Ohio

[73] Assignee: Parker-Hannifin Corporation, Cleveland, Ohio

[21] Appl. No.: 373,835

[22] Filed: Jan. 17, 1995

[51] Int. Cl.[6] ..... B05B 7/10

[52] U.S. Cl. ..... 239/402; 239/406; 239/416.4; 137/505.25; 60/736

[58] Field of Search ..... 239/399, 402, 239/403, 406, 423, 424, 410, 412, 463, 533.9, 416.4, 416.5; 137/505.25; 60/748, 737, 736, 741

[56] References Cited

U.S. PATENT DOCUMENTS

| | | | |
|---|---|---|---|
| 2,144,874 | 4/1937 | Edwards | 239/107.3 |
| 2,574,865 | 6/1947 | Edwards | 239/118 |
| 2,775,484 | 12/1956 | Fox | 60/741 |
| 3,234,731 | 2/1966 | Dermody et al. | 60/741 |
| 3,406,910 | 10/1968 | Simmons | 239/464 |
| 3,598,321 | 8/1971 | Bobzin | 239/400 |
| 3,684,186 | 8/1972 | Helmrich | 239/400 |
| 3,866,839 | 2/1975 | Magner | 239/416.5 |
| 3,980,233 | 9/1976 | Simmons et al. | 239/400 |
| 4,170,108 | 10/1979 | Mobsby | 60/39.74 R |
| 4,593,720 | 6/1986 | Bergandy | 137/859 |
| 4,600,151 | 7/1986 | Bradley | 239/400 |
| 4,638,636 | 1/1987 | Cohen | 60/741 |
| 4,754,922 | 7/1988 | Halvorsen et al. | 239/5 |
| 4,831,700 | 5/1989 | Halvorsen et al. | 29/156.7 |
| 4,938,417 | 7/1990 | Halvorsen | 239/5 |
| 4,962,889 | 10/1990 | Halvorsen | 239/410 |
| 5,014,918 | 5/1991 | Halvorsen | 239/410 |
| 5,102,054 | 4/1992 | Halvorsen | 239/533.2 |
| 5,174,504 | 12/1992 | Halvorsen | 239/410 |
| 5,197,290 | 3/1993 | Lee et al. | 60/748 |
| 5,242,117 | 9/1993 | D'Agostino | 60/741 |
| 5,265,415 | 11/1993 | Cox, Jr. | 60/258 |
| 5,505,045 | 4/1996 | Lee et al. | 239/424 |

*Primary Examiner*—Andres Kashnikow
*Assistant Examiner*—Lisa Ann Douglas
*Attorney, Agent, or Firm*—Christopher H. Hunter

[57] ABSTRACT

An airblast fuel nozzle has an injector head with an extension or support strut. An annular valve spool with a fuel discharge orifice is fixed to the head and a metering assembly surrounds the valve spool. The metering assembly includes an axially-slidable annular valve sleeve and a metal bellows. The bellows, a compression spring, and one or more shims between the valve spool and the injector head provide a preset bias on the valve sleeve such that the valve sleeve initially closes or minimizes the fuel metering area through longitudinally-extending fuel swirl slots spaced about the valve spool at the discharge orifice. When fuel under pressure flows through the injector, the fuel pressure overcomes the preset bias of the sleeve and moves the valve sleeve axially with respect to the valve spool, thereby increasing the fuel metering area through the fuel swirl slots and allowing fuel to flow (with a swirling component) therethrough. The fuel flows through a convoluted path through a fuel circuit surrounding the bellows and valve sleeve, around the bellows, and between the valve sleeve and valve spool to the fuel swirl slots. The convoluted fuel path and fuel metering at the tip of the fuel injector reduces vaporization and coking of the fuel. The bellows, springs and shims provide for easily configuring the metering valve assembly to optimize fuel flow for the particular requirements of the engine.

30 Claims, 6 Drawing Sheets

AIRBLAST FUEL NOZZLE WITH SWIRL SLOT METERING VALVE

FIELD OF THE INVENTION

The present invention relates generally to fuel nozzle construction, and more particularly to a metering valve assembly for the fuel nozzle of a gas turbine engine.

BACKGROUND OF THE INVENTION

Airblast fuel nozzles for gas turbine engines typically have an injector with generally concentric chambers for inner and outer air flow and intermediate fuel flow, and generally concentric discharge orifices for discharging and intermixing the inner and outer air flows and fuel flow in the combustor. A tubular extension or support strut extends from the head of the injector for attachment to the casing of the engine to support the tip of the injector relative to the combustor casing. A central fuel passage extends from a fuel pump through the extension to supply pressurized fuel to the injector. Helmrich, U.S. Pat. No. 3,684,186; Simmons, et al., U.S. Pat. No. 3,980,233; Halvorsen, U.S. Pat. No. 4,902,889; Halvorsen, U.S. Pat. No. 4,754,922; Halvorsen, U.S. Pat. No. 5,014,918; and Mobsby, U.S. Pat. No. 4,170,108 describe and illustrate this type of airblast fuel nozzle.

Airblast fuel nozzles have employed a valve upstream in the fuel passage leading to the injector head (and outside the combustor case) to compensate for pressure head effects and provide adequate fuel distribution to the engine combustor. Although fuel back pressure is thereby maintained up to this valve, this valve can be considerably upstream from the tip (discharge orifice) of the injector. This can cause fuel at low pressures and velocities downstream of the valve to vaporize and/or coke at high fuel temperatures. Fuel vaporization and coking in the injector head can cause pulsing or intermittent interruptions in fuel flow, limit or prevent fuel flow, and in general, cause combustion instability and adversely affect the operation of the engine.

Airblast fuel injectors have been developed in an attempt to reduce fuel vaporization and coking at elevated fuel temperatures. Some injectors have a valve within the injector head which is closed when fuel pressure is below a minimum selected value, and open when fuel pressure exceeds this value. Halvorsen, U.S. Pat. No. 5,014,918, shows such an injector where an arcuate seat is formed in an annular fuel chamber between an inner and outer air chamber in the injector, and an arcuate spring valve is disposed in the valve seat. The arcuate spring valve opens after the cracking pressure of the valve has been exceeded, and closes when the pressure drops below the cracking pressure. The placement of the valve in the injector head maintains fuel back pressure to the nozzle head and can thereby reduce fuel vaporization and coking through at least a portion of the injector.

Other references which show valves in the injector head include U.S. Pat. Nos. 3,598,321; 4,593,720; 5,197,290 (leaf- spring valves); U.S. Pat. Nos. 4,962,889; 5,014,918; 5,174,504; 4,962,889; 4,831,700; 5,754,922 (annular spring valves); U.S. Pat. Nos. 5,102,054; 4,938,417 (tubular metering valves); and U.S. Pat. No. 5,265,415 (internal reed valves).

While the above-described types of injectors increase the fuel flow back pressure through a portion of the injector, and thus can reduce fuel vaporization and coking, they are not without drawbacks. For example, some of the valves in the injector heads are located upstream from the tip (discharge orifice) of the injector, which can still allow vaporization or coking of the fuel to occur between the valve and the tip of the injector.

While injectors have also been developed where a valve is located at the tip of the injector (see, e.g., U.S. Pat. Nos. 2,144,874 and 4,638,636), it is believed that these injectors have been limited to a diaphragm-type of valve which can have a high rate of flow increase (high gain) after the valve cracking pressure is exceeded. A high rate of flow increase through a valve, however, can magnify inconsistencies or variations in stroke effects. It is also believed that the swirl component of the fuel stream in a diaphragm-type of valve is reduced at higher flow rates, which therefore reduces the intermixing of the air and fuel and hence reduces the combustion efficiency of the engine. Thus, a diaphragm-type of valve can be undesirable in some operating conditions.

In any case, it is also believed that the above-described types of injectors can be complicated or difficult to manufacture to precise operating standards, can be difficult (or impossible) to easily tailor or configure to particular engine characteristics, and can have issues with repeatability and dependability over extended use.

As such, it is believed that there is a demand in the industry for an airblast fuel injector for a gas turbine engine which reduces vaporization of the fuel, can be easily tailored or configured to the particular characteristics of the engine to maximize engine efficiency, and is repeatable and dependable over an extended life cycle.

SUMMARY OF THE INVENTION

The present invention provides a novel and unique fuel nozzle for a gas turbine engine, and more particularly provides a novel and unique metering valve assembly for the injector head of the nozzle. The metering valve assembly includes an axially slidable valve sleeve and metal bellows in the injector head which meter fuel at the fuel discharge orifice of the injector. The metering valve assembly maintains fuel at a high pressure and high velocity to the fuel discharge orifice of the injector, can be easily tailored or configured for the particular characteristics of the engine, and is repeatable and dependable over an extended life cycle.

According to the present invention, the metering valve assembly is disposed in an annular fuel chamber in the injector head. The injector head also includes an annular valve spool disposed radially inward of the fuel chamber and fixed relative to the head to define an axially-extending inner air swirler. One or more concentric annular air swirlers are disposed radially outwardly from the fuel chamber. An extension or support strut extends from the injector head to an attachment in the combustor casing of the engine. The metering valve assembly meters fuel passing through a passage in the extension to fuel swirl slots formed at the fuel discharge orifice of the valve spool. The fuel is then intermixed with air from the inner and outer air swirlers for combustion in the engine.

The valve sleeve of the metering valve assembly provides an annular fuel path between the valve sleeve and the inner valve spool which extends to the fuel swirl slots at the fuel discharge orifice of the valve spool. The relative axial displacement of the valve sleeve with respect to the valve spool varies the flow metering area through the fuel swirl slots. The fuel swirl slots are formed longitudinally in a radially-enlarged annular band region at the discharge orifice of the valve spool. The fuel swirl slots of the valve spool preferably have a profiled, e.g., tapered, axial configuration such that the flow through the fuel slots increases (or decreases) as the valve sleeve moves axially with respect to the valve spool. The fuel swirl slots are also angled or slanted in the axial direction such that a swirl component to the fuel is maintained even when the fuel metering area through the slots is at a maximum.

The metal bellows preferably surrounds the valve sleeve and extends between the valve sleeve and the housing for the injector head. The bellows provides a preset bias on the valve sleeve to normally maintain the valve sleeve at a position which restricts or closes the fuel metering area to the fuel swirl slots. A compression spring and one (or more) trim shims are also disposed between the sleeve and the inner valve spool. The bias on the sleeve can be easily configured by installing a bellows or spring with a particular spring constant and/or adding (or subtracting) shims as necessary between the spring and the inner valve spool or the sleeve flange.

As the fuel pressure increases upstream of the metering valve assembly, the pressure across the bellows and valve sleeve overcomes the preset bias on the sleeve and causes the valve sleeve to move axially downstream with respect to the valve spool. When the sleeve moves downstream, the flow metering area through the fuel swirl slots increases to provide greater fuel flow for combustion in the engine. If the fuel pressure decreases through the metering assembly, the valve sleeve returns to its original axial location along the valve spool to restrict (or close) the flow metering area through the fuel swirl slots. The inner valve spool can also be adjusted in the upstream or downstream direction within the valve head by the addition (or subtraction) of shims between the valve spool and the extension for the injector head to adjust the cracking pressure of the valve sleeve.

By providing fuel metering at the tip (discharge orifice) of the injector head, fuel back pressure is maintained through the entire nozzle fuel path and fuel vaporization and coking is reduced through the nozzle. The selection of bellows, compression spring and shims to tailor the preset bias on the valve sleeve and the valve cracking pressure also enables the flow metering area to be opened at a low (or no) valve cracking pressure, and to have a low rate of flow increase above the valve cracking pressure such that inconsistencies or variations in stroke effects of the metering valve assembly are minimized. The swirl component to the :fuel is maintained even at high pressures by always directing the fuel through at least a portion of the fuel swirl slots. The bellows, compression spring and shims can be easily chosen to configure the metering valve assembly to optimize fuel flow through the nozzle for particular engine requirements.

Finally, a convoluted fuel passage is provided through the fuel chamber to maintain high fuel velocity through the injector head and thereby further reduce fuel vaporization and coking. To this end, an outer fuel conduit is provided around the valve sleeve and bellows of the metering assembly to initially direct fuel downstream in the fuel chamber. The outer fuel conduit comprises an inner tube, an outer tube, and longitudinal webs which extend between and thermally interconnect the inner tube and outer tube. The fuel then flows upstream between the bellows and outer fuel conduit and then downstream between the valve sleeve and valve spool. The longitudinal webs in the outer fuel conduit and the flow path between the bellows and the outer fuel conduit and between the valve sleeve and valve spool are restricted flow paths which maintain high fuel velocity through the fuel chamber. The fuel paths are also in heat transfer relation to further prevent vaporization and coking of the fuel.

The present invention also provides a method for metering fuel in an airblast fuel nozzle whereby a sliding valve sleeve with a preset spring bias moves axially with respect to a valve spool in the injector head depending upon fuel pressure within the nozzle to meter fuel at the tip of the injector head.

Thus, as described above, the airblast fuel nozzle of the present invention provides for effective metering of fuel at the injector tip of the nozzle and maintains fuel at a high back pressure and high velocity through the entire injector fuel path to reduce fuel vaporization and coking. The metering valve assembly in the nozzle is easily tailored or configured for the particular characteristics of the engine, including tailoring the valve cracking pressure and flow increase (gain) while maintaining a swirl component to the fuel stream. The components of the metering valve assembly are also repeatable and dependable.

Further features and advantages of the present invention will become further apparent upon reviewing the following specification and accompanying drawings.

DETAILED DESCRIPTION OF THE PREFERRED EMBODIMENT

Figure 1:
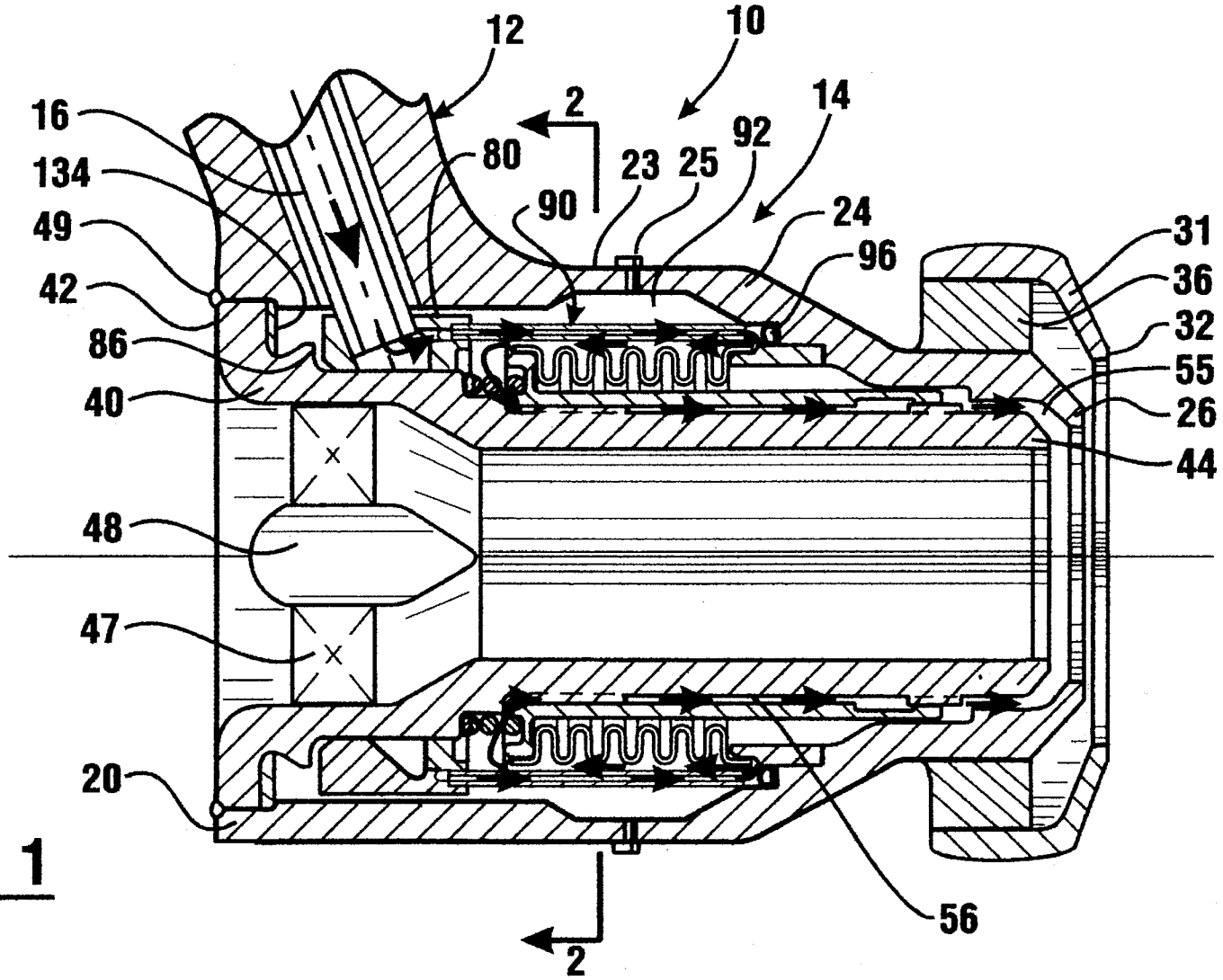
FIG. 1 is a longitudinal cross-sectional view of one embodiment of the airblast fuel nozzle of the present invention, showing the metering valve assembly in the injector head in its closed position.
Figure 2:
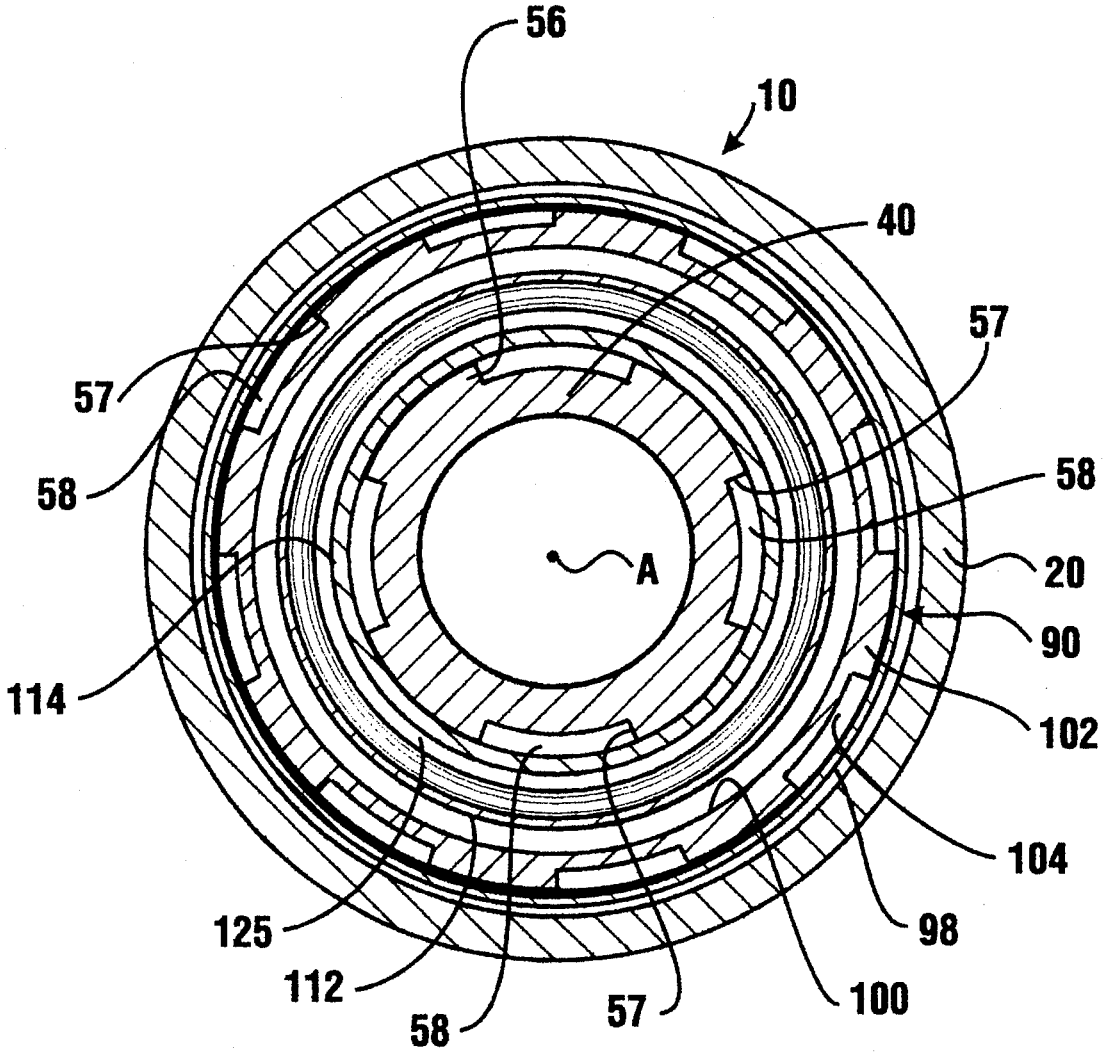
FIG. 2 is a cross-sectional upstream view of the nozzle taken substantially along the plane described by the lines 2—2 of FIG. 1.

Referring to the drawings, and initially to FIGS. 1 and 2, an airblast fuel nozzle constructed according to one preferred embodiment of the present invention is indicated generally at 10. The airblast fuel nozzle 10 includes an extension or support strut, indicated generally at 12, and an injector head, indicated generally at 14. The extension 12 is preferably formed from an appropriate high-temperature corrosion-resistant alloy (e.g., Hast-X metal) and is attached at its upstream end to the combustor casing of the engine to support the injector head 14 within the casing. Extension 12 includes a fuel tube or passage 16 extending centrally through the extension. Passage 16 is also preferably formed from an appropriate corrosion-resistant alloy (e.g., stainless steel type 347), and directs pressurized fuel from an upstream fuel pump (not shown) to the injector head 14. Passage 16 can include a conventional valve (also not shown) upstream from the injector head to meter the fluid into the injector head, as is known.

The downstream end of extension 12 includes an annular collar 20 preferably formed in one piece with extension 12 and circumscribing the longitudinal axis "A" of the injector head. An annular collar flange 23 extends downstream from collar 20. An annular outer housing 24 is then attached (e.g., brazed or welded at 25) to flange 23 and extends further downstream therefrom. Outer housing 24 tapers inwardly at its distal end 26 toward the axis A of the injector head to define a fuel discharge orifice. Insulating air gaps can also be provided in housing 24 for high temperature protection as is known to those of ordinary skill in the art. Housing 24 is also preferably formed from an appropriate high-temperature, corrosion-resistant alloy (e.g., HAST-X metal).

An outer air swirler is disposed radially outward from housing 24. The outer air swirler includes an annular collar 31 which tapers inwardly at its distal end 32 toward the axis A of the injector head to define an air discharge orifice. The outer air swirler also includes spiral blades 36 disposed between collar 31 and housing 24 to direct the air flow in a swirling manner. The outer air swirler and is preferably formed from high-temperature, corrosion-resistant alloy (e.g., HAST-X metal).

An annular valve spool 40 is disposed radially inward of collar 20. Valve spool 40 is also formed from an appropriate corrosion-resistant alloy (e.g., INCO 625), and includes an enlarged, outwardly tapered upstream air inlet orifice 42 and an inwardly tapered downstream air discharge orifice 44. The valve spool 40 is attached in a conventional manner (e.g., brazed or welded at 49) to injector head 14. Insulating air gaps can also be provided in valve spool 40 for high temperature protection as is known to those of ordinary skill in the art. An inner air swirler is disposed within valve spool 40 proximate the inlet orifice 42. The inner air swirler includes spiral blades 47 extending radially outward from a central annular post 48. Spiral blades 47 direct air in a swirling manner through the injector head. The inner air-swirler is also formed from an appropriate high-temperature, corrosion-resistant alloy (e.g., HAST-X metal).

Referring now to FIGS. 1, 3, 4 and 5, a plurality of fuel swirl slots 50 are disposed in even, spaced-apart relation around the outer surface of valve spool 40. Preferably eight fuel swirl slots are provided for the even distribution of fuel into the combustor. The fuel swirl slots are preferably formed in a narrow, annular, radially-enlarged band 51 on the outer surface of the valve spool proximate the air discharge orifice 44. Each fuel swirl slot extends longitudinally across a portion of the band and preferably has a constant radial depth (see FIG. 4). Each slot is also angled or slanted relative to the axial direction. That is, slot edge "B" closest to the axial direction preferably extends at an angle Ø of preferably between 30° and 45° to the longitudinal axis A of the injector head (see FIG. 5). The angle to the slots impart an appropriate swirl component to fuel passing therethrough.

Additionally, each slot can be outwardly-tapered in the downstream direction. For example, each slot can taper longitudinally from a narrow end or point 52 to an enlarged end 54 at the downstream end of band 51. Each slot preferably tapers outwardly at an angle ω, which can vary depending upon the particular fuel requirements. A tapered configuration for the slots facilitates metering the fuel flow through the fuel slots, as will be described herein in more detail. The enlarged or downstream end 54 of each slot is then in fluid communication with an annular conduit 55 formed between the outer surface of valve spool 40 and the inner surface of outer housing 24 to discharge opening 26. The fuel swirl slots can of course have other configurations depending upon the requirements of the gas turbine engine.

Figure 3:
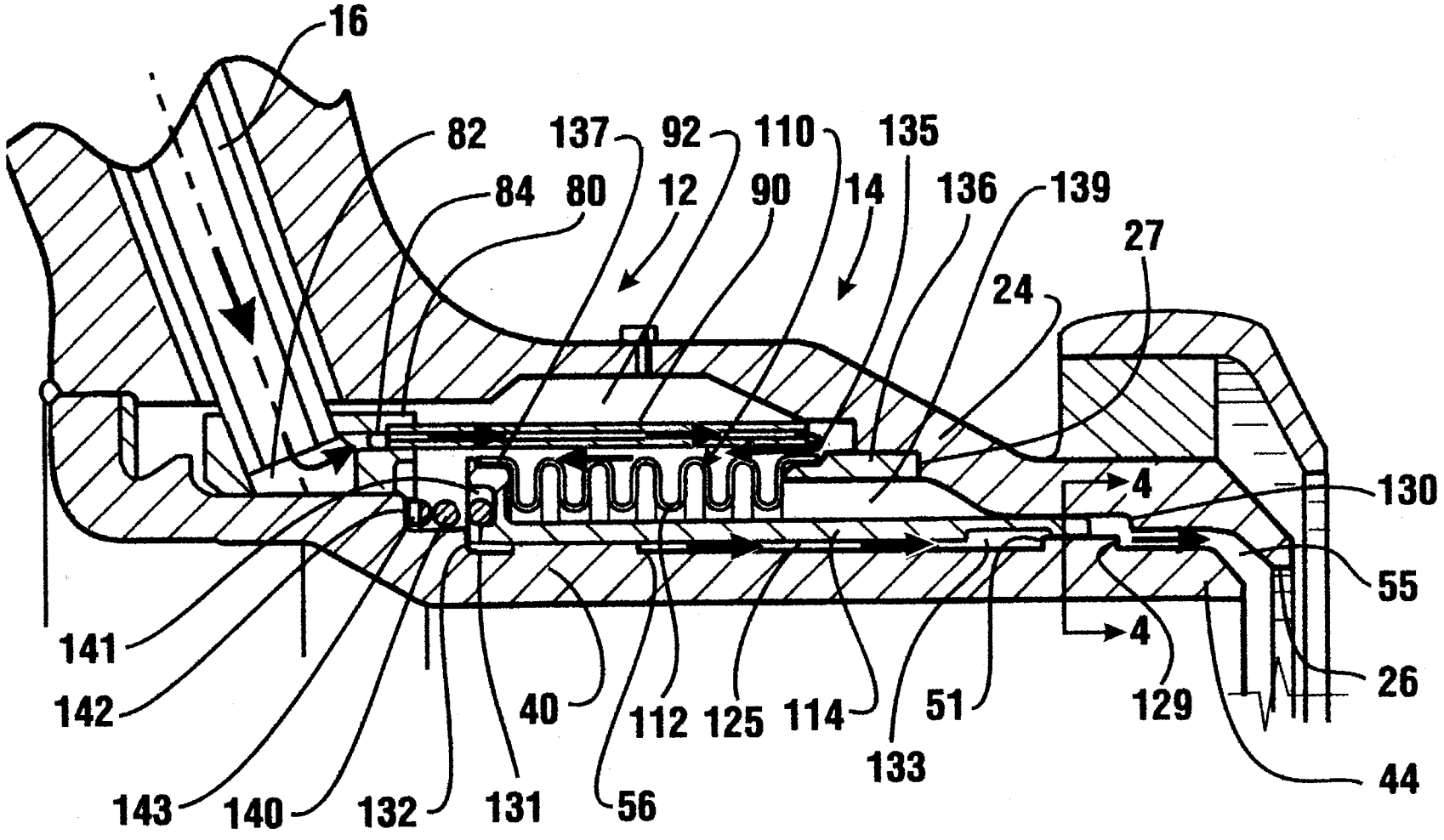
FIG. 3 is an enlarged cross-sectional view of the metering valve assembly in the injector head of FIG. 1.
Figure 5:
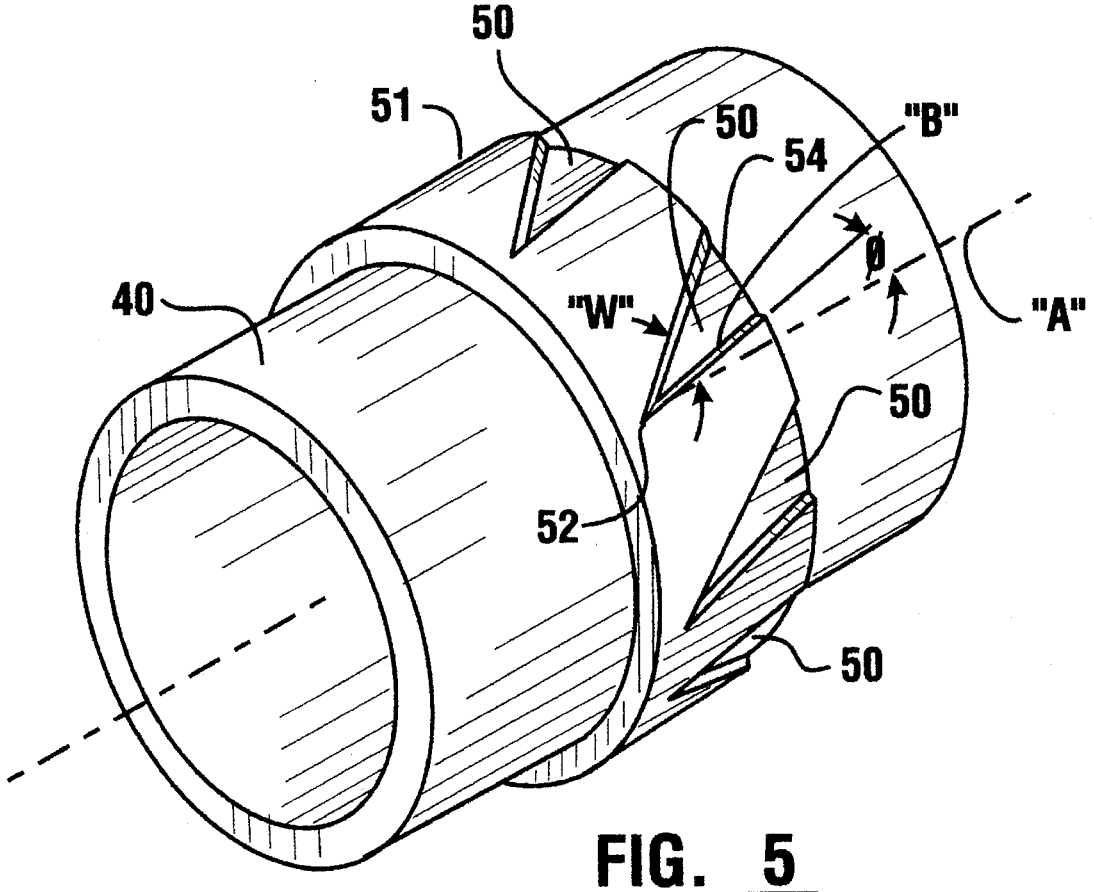
FIG. 5 is an isometric view of the valve sleeve and valve spool of the nozzle taken substantially along the plane described by the lines 5—5 of FIG. 4.
Figure 4:
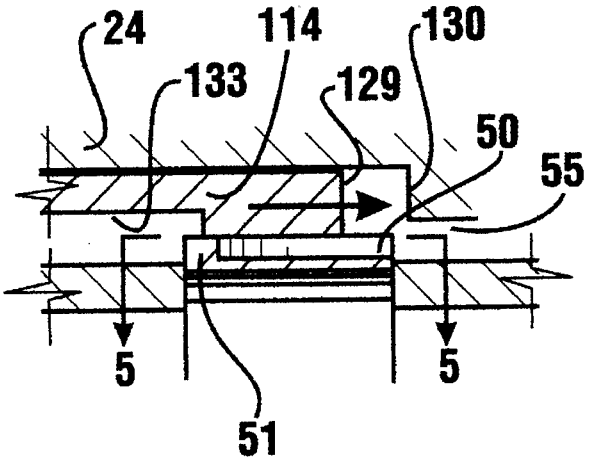
FIG. 4 is a sectional view of the valve sleeve and fuel swirl slots in the nozzle taken substantially along the plane defined by lines 4—4 of FIG. 3.

As shown in FIGS. 1–3, valve spool 40 also includes a radially-enlarged annular band 56 toward the upstream end of the spool. Band 56 includes longitudinally-extending webs 57, which extend radially outward to define interstitial spaces 58 for fuel flow (see FIG. 2). Preferably band 56 has four webs for the proper distribution of fuel. Webs 57 also restrict the fuel flow path to increase the velocity of the fuel, as will be described herein in more detail.

An annular tip adapter 80 is disposed radially outward from spool 40 proximate the inlet orifice 42. Tip adapter 80 is also preferably formed from an appropriate corrosion-resistant alloy (e.g., stainless steel type 347) and receives the output end of fuel inlet tube 16, which is preferably brazed or welded thereto. Tip adapter 80 includes an annular, wedge-shaped (in cross-section) fuel chamber 82 which receives fuel from tube 16 and directs the fuel downstream through circumferentially-spaced slots in the adapter to annular channel 84. The tip adapter 80 preferably abuts a radially-outward extending shoulder 86 formed in spool 40 at the upstream end of the adapter.

An annular fuel conduit, indicated generally at 90, extends between the downstream end of adapter 80 and flange 23 of collar 20. Fuel conduit 90 is disposed within an annular fuel chamber, indicated generally at 92, between the inner valve spool 40 and outer collar 20. The upstream end of conduit 90 is received within a short annular counterbore formed in channel 84 of the tip adapter 80 (and welded or brazed thereto), while the downstream end of conduit 90 fits within outer housing 24 and creates an annular fuel channel 96. Conduit 90 fluidly interconnects upstream channel 84 with downstream channel 96.

As shown most clearly in FIG. 2, fuel conduit 90 comprises an outer annular tube 98 and an inner annular tube 100. A plurality of longitudinally-extending webs 102 preferably extend between and interconnect inner tube and outer tube 98. Webs 102 are preferably formed in one piece with inner tube 100, and define a plurality of interstitial spaces 104 for fuel flow through conduit 90. The inner and outer tubes and longitudinal webs are preferably formed from an appropriate corrosion-resistant alloy (e.g., type 347 stainless steel). Longitudinal webs 102 limit the area through which the fuel can pass, and thereby cause the fuel to flow at a high velocity through fuel conduit 90. Preferably the webs double the velocity of fuel flow through conduit 90, as compared to a conduit without these webs. Webs 102 also transfer heat between the inner tube 100 and outer tube 98 for heat protection.

Referring now to FIG. 3, a metering valve assembly, indicated generally at 110, is also disposed within fuel chamber 92. Metering valve assembly 110 meters fuel from fuel conduit 90 to fuel swirl slots 50. The metering valve assembly 110 includes an annular metal bellows 112 and an axially-slidable annular sleeve 114. Sleeve 114 is concentric with and in relatively close proximity to spool 40. Preferably sleeve 114 is comprised of an appropriate corrosion-resistant alloy (e.g., INCO 625). The inner surface of sleeve 114 and the outer surface of spool 40 define an annular fuel conduit 125 extending longitudinally between valve spool 40 and sleeve 114 to swirl slots 50. Annular bands 51 and 56 provide a radial set-off between spool 40 and sleeve 114 as sleeve 114 moves axially with respect to spool 40.

Sleeve 114 can move axially downstream with respect to spool 40 until the downstream distal end 129 of sleeve 114 engages a radially-inward directed annular shoulder 130 on sleeve 24. The distal end 129 of sleeve 114 slides between the inside surface of sleeve 24 and band 51. Preferably, the mating surfaces of bands 51 and 56 and sleeves 24 and 114 are coated or layered with an abrasion-resistent material, for example chrome plating. The sleeve 114 can also move axially upstream until the upstream end 131 of the sleeve engages a radially-outward directed annular shoulder 132 on valve spool 40. Stand-offs or slots are formed in the upstream end 13 1 of the sleeve such that a fuel flow path is maintained between the upstream end of the sleeve and the valve spool 40 when the sleeve is in its maximum upstream position. The amount of upstream and downstream movement of sleeve 114 defines the valve stroke of the sleeve.

The downstream end 129 of sleeve 114 also includes a radially-enlarged groove 133 formed on the inside surface of the sleeve. When sleeve 114 is in its initial upstream or closed position (FIGS. 1, 3, 4), groove 133 is entirely or substantially out of radial alignment with fuel swirl slots 50, and thus the fuel metering area through these slots is closed or at least at a minimum. Groove 133 gradually becomes radially aligned with fuel swirl slots 50 on the mating diameter of spool 40 as sleeve 114 moves axially downstream with respect to spool 40. At the maximum stroke, that is, when sleeve end 129 abuts shoulder 130 (FIGS. 6, 7), substantially the entire groove 133 is radially aligned with swirl slots 50 and fuel can flow radially inward into the fuel swirl slots across the entire aligned area, and then longitudinally outward along the slots into channel 55. As such, the fuel metering area (the "metering window") through groove 133 to swirl slots 50 increases as the sleeve moves downstream with respect to the valve spool (compare, e.g., FIGS. 4 and 7).

It is important to point out that the swirl component to the fuel passing through slots 50 is maintained even when the sleeve is at its maximum stroke (FIGS. 6, 7) because fuel is always directed through at least a portion of the angled fuel swirl slots. As discussed above, the initial position of the sleeve and spool is preferably such that the metering area to the fuel swirl slots is closed. However, the annular groove 133 can be axially lengthened (or shortened) in the downstream direction to provide for a small amount of fuel flow through slots 50 even when the sleeve 114 is at its initial upstream position. Alternatively or additionally, annular disc-like shims 134 (FIG. 1) can be added (or subtracted) between the upstream end of spool 40 and collar 20 to move the entire spool 40 axially with respect to sleeve 114 (which is attached through bellows 112, sleeve 136 and outer housing 24 to collar 20), to thereby align a small portion of channel 133 in sleeve 114 with swirl slots 50 when sleeve 114 is in its initial position.

A preset bias is provided on sliding sleeve 114 such that this sleeve uncovers more of the metering area through the slots when the fuel pressure through the metering assembly increases. To this end, metal bellows 112 is preferably attached in surrounding and concentric relation with sleeve 114. The downstream end 135 of bellows 112 is secured (such as by welding or brazing) to an annular sleeve 136. Annular sleeve 136 is secured (such as by welding or brazing at 27) to outer housing 24. A gap (not numbered) is provided between the downstream end 135 of bellows 112 and fluid conduit 90 for fuel flow therebetween. The upstream end 137 of the bellows is received about a radially-outwardly extending annular flange 138 on sleeve 114, and is attached thereto in a conventional manner (such as by welding or brazing). A gap (not numbered) is also provided between the upstream end 137 of bellows 112 and fluid conduit 90 for fuel flow therebetween. The inside surface of bellows 112, the outside surface of sleeve 114 and the inside surface of outer housing 24 also create an insulating air gap 139 for heat protection.

The material composition, thickness, diameter and number of convolutions of the bellows 112 affects the spring constant of the bellows. Preferably, the bellows are comprised of a two-ply metal sheet (INCO 625) having a thickness of $^{8}/_{1000}$ inch ($^{4}/_{1000}$inch per layer), an internal diameter of 0.700 inch, an external diameter of 0.875 inch and 5 convolutions.

Additionally, an annular compression spring 140 is disposed between an annular groove 141 in the upstream end of sleeve flange 138 and a radially-outwardly projecting annular shoulder 142 on spool 40. Spring 140 is preferably comprised of appropriate corrosion-resistant material (e.g., INCO-X 750). One or more annular disc-like shims 143 can also be disposed between shoulder 142 and spring 140 (and/or between flange 138 and spring 140) to increase the compression of spring 140. Shims 143 are also comprised of appropriate corrosion-resistant material, for example type 410 stainless steel.

Figure 6:
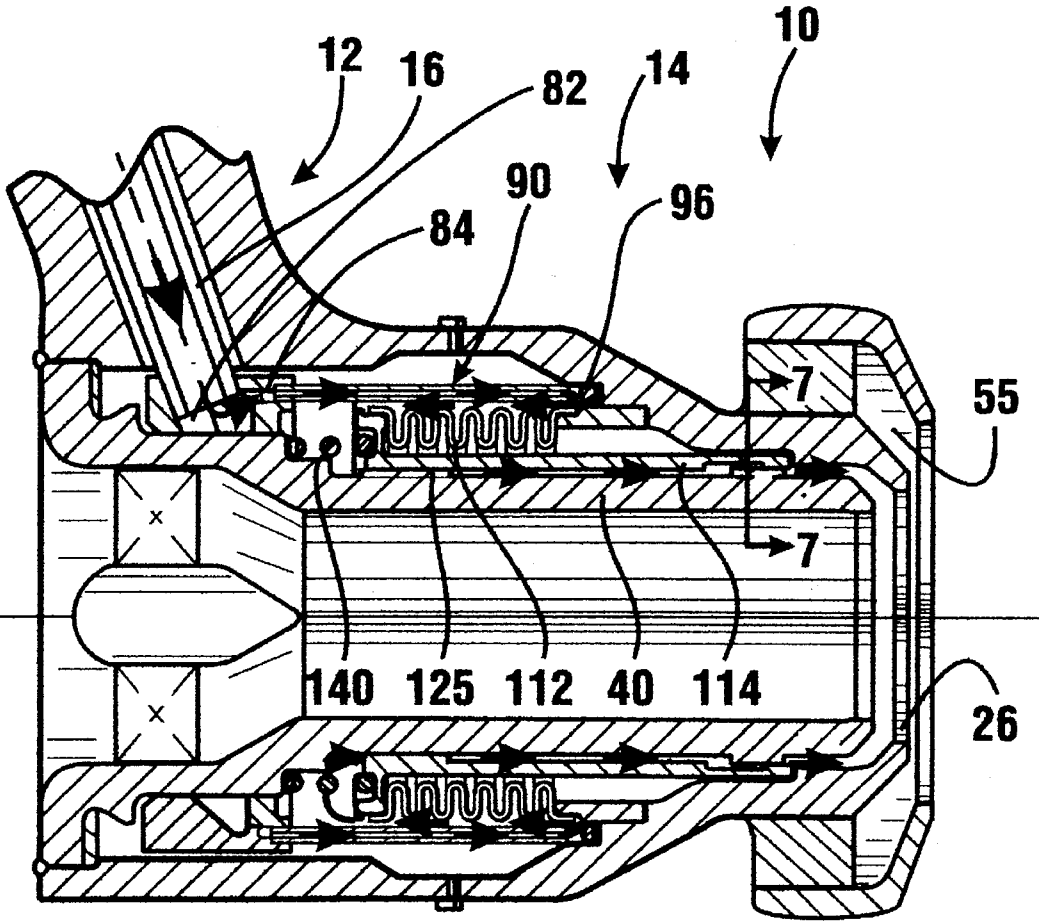
FIG. 6 is a cross-sectional view of the airblast fuel nozzle similar to FIG. 1, but showing the metering valve assembly of the injector head in its open position.
Figure 7:
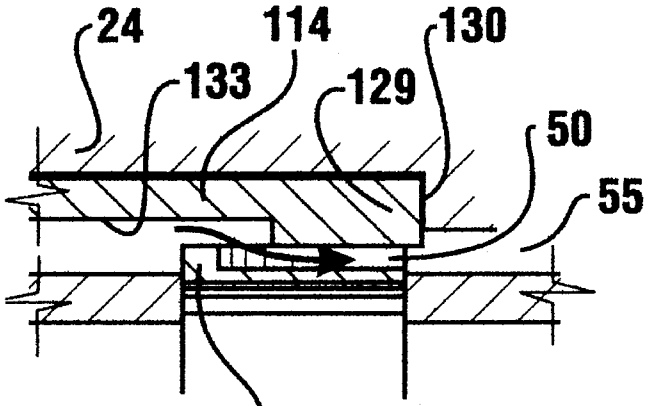
FIG. 7 is a sectional view of the valve sleeve and fuel swirl slots in the nozzle taken substantially along the plane described by the lines 7—7 of FIG. 5.

Bellows 112, compression spring 140 and shims 143 (if needed) are chosen such that the bias on sleeve 114 initially maintains the sleeve in the maximum upstream position (FIGS. 1, 3, 4) when there is no or minimum fuel pressure through the injector head. The bias is preferably also chosen such that at full fuel pressure, sleeve 114 moves axially to its maximum downstream position (FIGS. 6, 7). The amount of fuel pressure necessary to move the sleeve from the full upstream to downstream position can be tailored according to the particular engine requirements, however, the bellows 112, compression spring 140 and shims 143 are preferably chosen such that they provide a high force, low gain valve in the injector head. The spring bias against sleeve 114 can be easily configured by i) providing a compression spring 140 with a particular spring constant, ii) adding or subtracting shims 143 between the spring 140 and shoulder 142 or flange 138, as necessary, or iii) providing a bellows 112 with a different material, thickness, or number of convolutions so as to control the spring constant of the bellows.

The amount of spring bias necessary on the sleeve 114 for a particular engine application can be determined from the valve metering area (slot diameter) subtracted from the mean force area across the bellows (average diameter). When this is multiplied by the maximum fuel pressure through the nozzle, the resultant value provides the maximum force area across the bellows. This value can also be calculated for the minimum force area at minimum fuel pressure across the bellows to determine the force gain. From this value, appropriate configurations for the bellows, compression spring and shims can be determined to meet the particular engine requirements. The bellows, trim shims and spring also allow for greater tolerances in manufacturing the components of the injector head by easily conforming the response of the components to the particular requirements of the engine.

Referring again to FIGS. 1 and 3, when fuel is directed through inlet passage 16, the fuel passes downstream through annular groove 82 and channel 84 to outer conduit 90. The fuel then passes upstream through channel 96 and between bellows 112 and conduit 90. The fuel then passes around the upstream end of bellows 112 and valve sleeve 114 (and through compression spring 140), and then downstream again between the valve sleeve 114 and valve spool 40 through conduit 125. As discussed previously, webs 102 in conduit 90 and webs 57 on band 56 restrict the fuel flow between spool 40 and sleeve 114, and thus increase the fuel velocity through conduits 90 and 125. The convoluted, leak-free flow path through the fuel chamber provides cooling for the fuel and minimizes exposure of low velocity (or stagnant) fuel to high wetted wall temperatures. Heat can transfer between the outer conduit 90 (by virtue of longitudinal webs 102), bellows 112 and sleeve 114, to further prevent vaporization or coking of the fuel.

When the pressure of the fuel through conduit 16 increases (such as at full engine throttle), the pressure across the bellows and sleeve increases above the preset bias of the sleeve and forces the sliding sleeve 114 axially downstream to increase the flow metering area through fuel swirl slots 50 (as shown in FIGS. 6 and 7). Again, the flow through the metering area preferably increases in a non-linear manner as the fuel pressure increases and a swirl component is imparted to the fuel. The non-linear increase in fuel flow through the fuel swirl slots is believed to provide optimum performance for gas turbine engines. However, the fuel swirl slots can be configured as necessary depending upon the particular requirements for the engine, for example to provide a linear increase in the fuel flow. Since the bellows have a relatively high force valve thereacross, the bellows are generally not susceptible to gumming or sticking. In any case, after the fuel passes through the fuel swirl slots 50, the swirling fuel enters the annular channel 55 where it then flows through fuel discharge orifice 26. The fuel then becomes intermixed with air from the inner and outer air swirlers for combustion in the engine.

When the fuel pressure decreases through passage 16, sleeve 114 is biased back towards its original axial position (FIGS. 3, 4), which closes or restricts the fuel metering area through fuel slots 50. As such, the bias on sleeve 114 maintains a fuel back pressure all the way to the metering area at the fuel swirl slots. Moreover, the restricted, convoluted flow path through the valve metering assembly maintains the fuel at a high velocity. The high back pressure and high velocity fuel reduce vaporization and coking of the fuel through the nozzle.

In assembling the injector head 14, it is preferred that the tip adapter 80 and outer conduit 90 be first attached to the fluid tube 16. The inner valve spool 40 is then attached, with the necessary shims 134 being inserted between the valve spool 40 and collar 20. The metering valve assembly is then installed in outer housing 24. Outer housing 24 is then attached to flange 23 which places the metering valve assembly in the fuel chamber between the collar 20 and spool 40.

Figure 8:
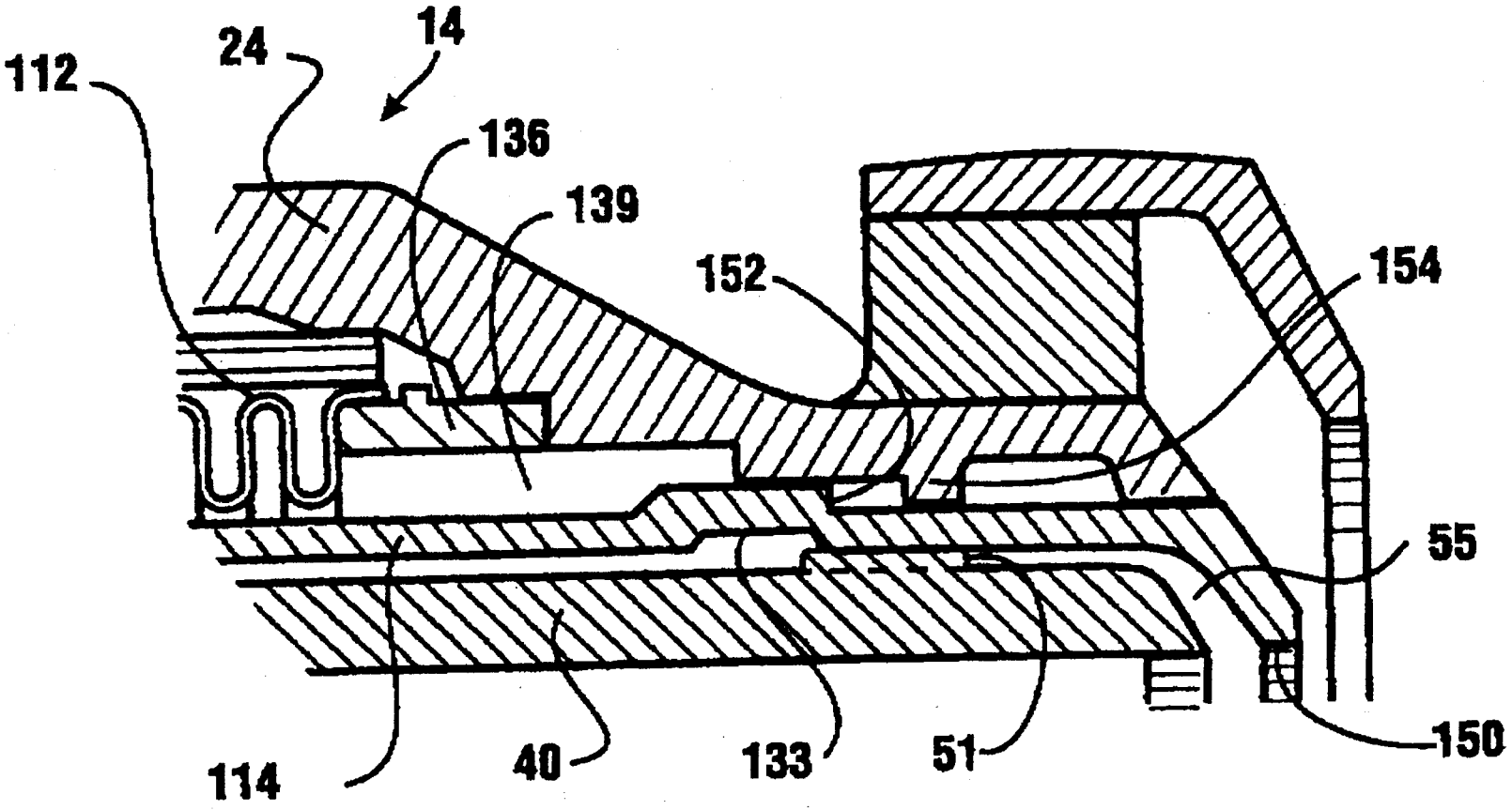
FIG. 8 is a longitudinal cross-sectional enlarged view of the valve sleeve and housing for another embodiment of the airblast fuel nozzle of the present invention, showing the metering valve of this embodiment in its closed position.

An additional embodiment of the present invention is illustrated in FIG. 8. In this embodiment, sleeve 114 extends axially downstream and tapers inwardly at its distal end 150 toward the axis of the injector head to define a fuel discharge orifice. Sleeve 114 and spool 40 thereby define the annular conduit 55 to the fuel discharge orifice. Also in this embodiment, sleeve 114 can move axially downstream with respect to spool 40 until a radially-enlarged annular shoulder 152 on sleeve 114 engages a radially-inward directed annular stop or flange 154 on outer housing 24. Again, when sleeve 114 is in its maximum downstream position, substantially the entire groove 133 in sleeve 114 is radially aligned with the swirl slots formed in band 51, as discussed previously with respect to the first embodiment of the present invention. Moreover, the remaining structure of the injector head 14 is the same as in the first embodiment, except that the inward taper at the distal downstream end of outer housing 24 which formed the discharge orifice is removed. Collar 136, however, still extends upstream from outer housing 24 for attachment to bellows 112. Finally, insulating chamber 139 is vented to the combustor. The remaining structure of the injector head is not illustrated in FIG. 8 nor discussed for the sake of brevity.

The operation of the metering assembly of this embodiment is also the same as in the first embodiment except that the distal end 150 of sleeve 114 forming the fuel discharge orifice reciprocates upstream and downstream within the injector head as sleeve 114 moves axially with respect to valve spool 40. This can provide a smoother transition for fuel exiting the discharge orifice of the fuel swirler and intermixing with air from the inner and outer air swirlers.

Thus, as described above, the present invention provides for metering fuel at the discharge orifice in the injector head, and maintains fuel pressure and velocity through the injector head to prevent vaporization and coking. Moreover, the metering assembly of the nozzle can be easily configured for the particular requirements of the gas turbine engine. The sliding valve and bellows of the metering valve assembly are rugged, durable components. These components provide dependable and repeatable performance for the fuel blast nozzle over an extended cycle life.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An airblast fuel nozzle having an injector head with a fuel inlet and a longitudinal axis, said injector head comprising:

an annular valve spool fixed relative to said head and defining an axially-extending inner air chamber with an air inlet orifice and an air discharge orifice, and having longitudinally-extending fuel slots spaced about an outer surface of the spool proximate the air discharge orifice, a metering valve assembly surrounding said valve spool, said metering valve assembly including an axially slidable annular valve sleeve and an annular bellows having circumferential convolutions, said bellows being attached at one end to said injector head and at the other end to said valve sleeve for providing a preset axial bias on said valve sleeve, said valve sleeve defining a fuel path from said fuel inlet to said fuel slots, the relative axial displacement of said valve sleeve with respect to said valve spool varying the fuel metering area through said fuel slots.

2. The airblast fuel nozzle as in claim 1, wherein said valve sleeve and valve spool have cooperating structure which varies the flow metering area through the fuel slots depending upon the relative axial displacement of the valve spool and valve sleeve.

3. The airblast fuel nozzle as in claim 2, wherein said cooperating structure includes a first surface on said valve sleeve and a mating second surface on said valve spool surrounding said fuel slots, said first surface on said valve sleeve moving axially with respect to said mating second surface on said valve spool to cover or uncover said fuel slots.

4. The airblast fuel nozzle as in claim 3, wherein said cooperating structure defines a fuel path directed radially inward toward the axis of the injector head.

5. The airblast fuel nozzle as in claim 4, wherein said valve sleeve includes an annular axial portion defining a fuel path between said sleeve and said valve spool and a radially-enlarged portion defining a fuel channel, whereby when said valve sleeve moves axially with respect to said valve spool, said fuel channel moves axially across and is aligned with said fuel slots.

6. The airblast fuel nozzle as in claim 5, further including a radially-outward extending portion on said valve sleeve, said biasing device surrounding said axial portion of said valve sleeve and extending between said injector head and said radially-outward extending portion.

7. The airblast fuel nozzle as in claim 6, wherein said valve sleeve and valve spool define a fuel discharge orifice.

8. The airblast fuel nozzle as in claim 3, wherein said fuel slots have an angled and axially-tapered configuration such that as the valve sleeve moves axially along the valve spool, a swirl component is provided to the fuel path.

9. The airblast fuel nozzle as in claim 1, wherein said bellows surround said valve sleeve.

10. The airblast fuel nozzle as in claim 1, wherein an annular fuel conduit surrounds said bias device and said valve spool, said fuel conduit including an inner tube and an outer tube, and longitudinally-extending webs interconnecting said inner tube and said outer tube and forming interstitial spaces therebetween for fuel flow therebetween.

11. The airblast fuel nozzle as in claim 1, further including means to vary the preset axial spring bias on said valve sleeve.

12. An airblast fuel nozzle having an injector head with a fuel inlet and a longitudinal axis, said injector head comprising:

an annular valve spool fixed relative to said head and defining an axially-extending inner air chamber with an air inlet orifice and an air discharge orifice, and having longitudinally-extending fuel slots spaced about an outer surface of the spool proximate the air discharge orifice, a metering valve assembly surrounding said valve spool, said metering valve assembly including an axially slidable annular valve sleeve and an annular bellows having circumferential convolutions, said bellows being attached at one end to said injector head and at the other end to said valve sleeve for providing a preset axial bias on said valve sleeve, said valve sleeve defining a fuel path from said fuel inlet to said fuel slots, and wherein said fuel path being formed in a convoluted path toward and away from said air discharge orifice of said valve spool between said inlet to said injector head and said fuel slots, the relative axial displacement of said valve sleeve with respect to said valve spool varying the fuel metering area through said fuel slots.

13. The airblast fuel nozzle as in claim 12, further comprising a first fuel path segment from said injector head inlet extending axially toward said air discharge orifice of the valve spool, a second fuel path segment extending from said first path away from said air discharge orifice of the valve spool between said first path and said bias device, and a third fuel path segment extending from said second path toward said air discharge orifice of said valve spool between said valve sleeve and said valve spool to said fuel slots.

14. A method for metering fuel through an air blast fuel nozzle with a longitudinal axis, comprising the steps of:

i) providing an inlet fuel passage to the nozzle;

ii) providing a fuel discharge orifice from the nozzle;

iii) providing a metering valve assembly between said inlet fuel passage and said fuel discharge orifice, said metering valve assembly including an axially slidable sleeve which covers and uncovers fuel swirl slots at the fuel discharge orifice depending upon the pressure of fuel through the nozzle, and an annular bellows surrounding said sleeve and normally biasing said sleeve to a position where the sleeve covers said fuel slots.

15. The method as in claim 14, further including the step of locating said bellows between and in connection with said sleeve and said nozzle.

16. The method as in claim 14, further including the step of providing a preset axial bias on said sleeve which normally maintains said sleeve in an axial position which blocks or substantially restricts fuel through the fuel swirl slots when there is little or no fuel pressure in the nozzle, and which allows said sleeve to move axially to a position which substantially uncovers said fuel swirl slots at a predetermined fuel pressure in the nozzle such that fuel flows through said fuel swirl slots to said fuel discharge orifice.

17. An airblast fuel nozzle having an injector head with a fuel inlet and a longitudinal axis, said injector head comprising:

an annular valve spool fixed relative to said head and defining an axially-extending inner air chamber with an air inlet orifice and an air discharge orifice, and having longitudinally-extending fuel slots spaced about an outer surface of the spool proximate the air discharge orifice, a metering valve assembly surrounding said valve spool, said metering valve assembly including an axially slidable annular valve sleeve and a biasing device for providing a preset axial bias on said valve sleeve, said valve sleeve defining a fuel path from said fuel inlet to said fuel slots, the relative axial displacement of said valve sleeve with respect to said valve spool varying the fuel metering area through said fuel slots, wherein a first segment of said fuel path is defined between said injector head and said valve sleeve, a second segment of said fuel path is defined between said valve sleeve and said valve spool, and a third segment of said fuel path is defined between said biasing device and said valve spool, said first, second and third fuel segments defining a convoluted fuel path.

18. An airblast fuel nozzle having an injector head with a fuel inlet and a longitudinal axis, said injector head comprising:

an annular valve spool fixed relative to said head and defining an axially-extending inner air chamber with an air inlet orifice and an air discharge orifice, and having longitudinally-extending fuel slots spaced about an outer surface of the spool proximate the air discharge orifice, a metering valve assembly surrounding said valve spool, said metering valve assembly including an axially slidable annular valve sleeve and a biasing device for providing a preset axial bias on said valve sleeve, said valve sleeve defining a fuel path from said fuel inlet to said fuel slots, the relative axial displacement of said valve sleeve with respect to said valve spool varying the fuel metering area through said fuel slots, and further including means to vary the preset axial spring bias on said valve sleeve, said mean including a compression spring surrounding said valve spool and disposed between said injector head and said biasing device, and one or more shims for varying the initial compression of said compression spring.

19. An airblast fuel nozzle having an injector head with a fuel inlet and a longitudinal axis, said injector head comprising:

a valve spool having an inlet end and an orifice end, and longitudinally-extending fuel slots formed in an outer cylindrical surface of the valve spool and extending toward the orifice end, said fuel slots having a geometry and orientation which impart a swirl component to fuel passing through the slots, and a metering valve assembly surrounding said valve spool, said metering valve assembly including an axially-slidable, longitudinally-extending annular valve sleeve and a biasing device between said valve sleeve and injector head for providing a preset axial bias on said valve sleeve relative to said valve spool, an inner surface of said valve sleeve and the outer surface of said valve spool defining an annular fuel path from said fuel inlet to said fuel slots, the relative axial displacement of said valve sleeve with respect to said valve spool varying the fuel metering area through said fuel slots.

20. The airblast fuel injector as in claim 19, wherein said valve sleeve and valve spool have cooperating structure which controls the flow metering area through the fuel slots depending upon the relative axial displacement of the valve spool and valve sleeve, said biasing device normally moving said valve sleeve with respect to said valve spool such that said metering area is at a minimum, and fuel pressure in said fuel path moving said valve sleeve with respect to said valve spool such that said fuel metering area is at a maximum.

21. The airblast fuel injector as in claim 20, wherein said cooperating structure includes a longitudinally-extending annular inner surface on said valve sleeve and a mating portion of the outer surface on said valve spool surrounding said fuel slots, said inner surface on said valve sleeve moving axially against said mating outer surface portion on said valve spool to cover or uncover said fuel slots, and said fuel path from said fuel inlet to said fuel slots is further defined axially and annularly between said inner surface of said valve sleeve and the outer surface of the valve spool, radially inward toward the axis of the injector head and into the fuel slots, and then axially and annularly along the fuel slots between the fuel slots and the inner surface of the valve sleeve to the orifice end of the valve spool.

22. The airblast fuel injector as in claim 21, wherein each of said fuel slots is defined by a pair of edges, with both edges of each of said fuel slots being disposed at an angle to the longitudinal axis of the injector head.

23. The airblast fuel injector as in claim 22, wherein said edges of each slot widen away from each other toward the orifice end of the valve spool such that as the valve sleeve moves axially against the bias with respect to the valve spool, the valve sleeve slides against the valve spool and uncovers an increasingly greater fuel metering area into said fuel slots.

24. The airblast fuel injector as in claim 23, wherein said valve sleeve includes an annular axial portion defining a fuel path between said valve sleeve and said valve spool, and a radially-enlarged portion defining an annular fuel channel, said fuel path between said valve sleeve and said valve spool being in fluid communication with said annular fuel channel, whereby when said valve sleeve moves axially with respect to said valve spool, said fuel channel moves axially across and is aligned with each of said fuel slots.

25. The airblast fuel injector as in claim 24, wherein the orifice end of said valve spool and an orifice end of said valve sleeve define a fuel discharge orifice for said injector head.

26. An airblast fuel nozzle having an injector head with a fuel inlet and a longitudinal axis, said injector head comprising:

a valve spool having an inlet end, and an orifice end, and an outer cylindrical surface, and a metering valve assembly including: i) an annular, longitudinally-extending valve sleeve surrounding said valve spool and axially moveable with respect thereto, and ii) a biasing device for providing a preset axial bias on said valve sleeve relative to said valve spool, said valve sleeve having an inlet end and an orifice end, said orifice end of said valve sleeve and said orifice end of said valve spool defining a fuel discharge orifice, an inner surface of said valve spool and the outer surface of said valve sleeve defining an annular fuel flow path from said fuel inlet to said fuel discharge orifice, said fuel flow path including fuel slots proximate the fuel discharge orifice with a geometry and orientation which impart a swirl component to fuel passing through the fuel slots, said valve sleeve and valve spool moving axially with respect to each other against the present axial bias as a result of the pressure of fuel passing through the fuel slots, the relative axial displacement of the valve sleeve and valve spool varying the fuel metering area through said fuel slots.

27. The airblast fuel nozzle as in claim 26, wherein said valve sleeve and valve spool have cooperating structure which controls the flow metering area through the fuel slots depending upon the relative axial displacement of the valve spool and valve sleeve, said biasing device normally moving said valve sleeve with respect to said valve spool such that said metering area is at a mimimum, and fuel pressure in said fuel path moving said valve sleeve with respect to said valve spool such that said fuel metering area is at a maximum.

28. The airblast fuel injector as in claim 27, wherein said cooperating structure includes a longitudinally-extending annular inner surface on said valve sleeve and a mating portion of the outer surface on said valve spool surrounding said fuel slots, said inner surface on said valve sleeve moving axially against said mating outer surface portion on said valve spool to cover or uncover said fuel slots, and said fuel path from said fuel inlet to said fuel slots is further defined axially and annularly between said inner surface of said valve sleeve and the outer surface of the valve spool, radially into the fuel slots, and then axially and annularly along the fuel slots to the discharge orifice of the injector head.

29. The airblast fuel injector as in claim 28, wherein each of said fuel slots is defined by a pair of edges, with both edges of each of said fuel slots being disposed at an angle to the longitudinal axis of the injector head.

30. The airblast fuel injector as in claim 29, wherein said edges of each slot widen away from each other toward the orifice end of the valve spool such that as the valve sleeve moves axially against the bias with respect to the valve spool, the valve sleeve slides against the valve spool and uncovers an increasingly greater fuel metering area into said fuel slots.

* * * * *